US006085906A

United States Patent [19]

Lambert

[11] Patent Number: 6,085,906

[45] Date of Patent: Jul. 11, 2000

[54] VACUUM SEALING SYSTEM

[76] Inventor: Francis Lambert, 1901 Spruce St., Boulder, Colo. 80302

[21] Appl. No.: 09/215,690

[22] Filed: Dec. 18, 1998

Related U.S. Application Data

[60] Provisional application No. 60/070,361, Jan. 2, 1998.

[51] Int. Cl.[7] ..... B65D 27/12

[52] U.S. Cl. ..... 206/524.8; 383/100

[58] Field of Search ..... 383/63, 100, 103; 206/524.8

[56] References Cited

U.S. PATENT DOCUMENTS

| | | | |
|---|---|---|---|
| Re. 28,969 | 9/1976 | Naito | 160/3 |
| 3,659,393 | 5/1972 | Richter | 53/22 A |
| 3,958,391 | 5/1976 | Kujubu | 53/22 B |
| 4,058,953 | 11/1977 | Sanborn, Jr. et al. | 53/22 A |
| 4,212,337 | 7/1980 | Kamp | 150/3 |
| 4,363,345 | 12/1982 | Scheibner | 150/3 |
| 4,581,764 | 4/1986 | Plock et al. | 383/101 |
| 4,782,951 | 11/1988 | Griesbach et al. | 206/484 |
| 4,829,641 | 5/1989 | Williams | 24/587 |
| 4,907,321 | 3/1990 | Williams | 24/587 |
| 5,254,074 | 10/1993 | Landers et al. | 493/213 |
| 5,339,602 | 8/1994 | Landers et al. | 53/410 |
| 5,403,094 | 4/1995 | Tomic | 383/63 |

*Primary Examiner*—Jacob K. Ackun

*Attorney, Agent, or Firm*—Townsend and Townsend and Crew LLP

[57] ABSTRACT

A vacuum sealing system that allows a user to vacuum pack the contents of a sealable container, while using the airtight sealing capabilities of the container. The vacuum is provided through a ventilation mechanism that is integrated into the airtight sealing system. The ventilation mechanism may also be sealed, either on its interior or exterior, as part of the airtight sealing system.

23 Claims, 4 Drawing Sheets

VACUUM SEALING SYSTEM

CROSS-REFERENCES TO RELATED APPLICATIONS

This application claims the benefit and priority of U. S. patent application No. 60/070,361, filed Jan. 2, 1998. The full disclosure of which is hereby incorporated by reference for all purposes.

BACKGROUND OF THE INVENTION

1. Field of the Invention

This invention relates to a sealable container and to methods for producing and using the same. More specifically, the invention relates to a sealable container where the container has a sealing system integrated with an evacuation system that allows a user to remove air from the body of the container.

2. Description of the Prior Art

The advent of bulk purchasing of food products and the trend toward reducing waste has prompted more and more consumers to employ sealable and airtight containers to store food products. The food products include for example meats, vegetables, snacks, sandwiches, leftovers, and the like, which require periodic and somewhat frequent consumer access. Typical sealable and reclosable containers, such as those commercially known as ZIPLOC® or GLAD-LOCK® bags, generally include airtight sealing systems which extend along the entire length of the container opening. The airtight sealing system usually has oppositely disposed seams that are interlocked by properly aligning the seams and joining the seams together along the entire length of the container opening. Thus, the products stored in the container can be easily removed and re-stored via the sealable opening.

Unfortunately, air can become trapped in the container upon initial sealing or re-sealing. The freshness and quality of the product stored within the sealable container is to a large measure dependent upon the container being substantially free of air. Thus, to preserve the contents of the container in a fresh state, without loss of flavor and texture, it is often desirable to evacuate or vacuum seal the container. Unfortunately, most sealable containers fail to provide a means for consumers to evacuate air from the body of the containers. In most cases, the consumer must try to squeeze the air from the container while simultaneously trying to seal the opening. With dry or granular goods some air may be removed, however, the volume of air removed is generally inadequate. Moreover, with wet items or liquids, removal of air by squeezing is very difficult. Consequently, a need exists for a sealable container that overcomes the foregoing drawbacks.

SUMMARY OF THE INVENTION

The present invention provides a vacuum sealing system that allows a user to vacuum pack the contents of a sealable container, while using the airtight sealing capabilities of the container. The vacuum is provided through a ventilation mechanism that is integrated into the airtight sealing system. The ventilation means may also be sealed, either on its interior or exterior, as part of the airtight sealing system. The sealing system may be contoured within the ventilation means.

The vacuum sealing system provides a low cost, easily manufactured, and highly convenient device for vacuum sealing a container.

In one embodiment, a sealable container is provided. The container has an airtight sealing system and defines a product cavity. The container also has a ventilation mechanism, integrated with the airtight sealing system. The ventilation mechanism has a sealing device accommodated by the sealing system so as to allow for airtight sealing of the ventilation mechanism. A vacuum storage environment is created in the container by evacuating air through the ventilation mechanism.

In yet another embodiment, a vacuum sealing system is provided for a sealable container, which has a container body having an opening and defining a product cavity therein. The system also includes a sealing device for sealing the container body. A tubular member is in communication with the product cavity and is capable of ventilating the product cavity to create a vacuum storage environment when the sealing device provides a seal.

In another aspect of the invention a method is provided which includes providing a sealable container having an opening and a product cavity; sealing a first sealing means to seal the opening; venting air from the product cavity through a tubular member, the tubular member being in communication with the product cavity; and sealing the tubular member with a second sealing means integrated into the interior of the tubular member.

In yet another aspect of the invention, an improved reclosable container of the type including a container body, which defines a product cavity, and a sealing device, is provided. The improvement includes an evacuation mechanism, in communication with the product cavity, used to ventilate the product cavity. After the ventilation the sealing device provides a seal to the container body and to the evacuation mechanism. Advantageously, the sealing device is integrated into an interior portion of the evacuation mechanism.

Additional aspects and embodiments of the present invention will become apparent upon a perusal of the following detailed description and accompanying drawings.

DESCRIPTION OF THE SPECIFIC EMBODIMENTS

Figure 1:
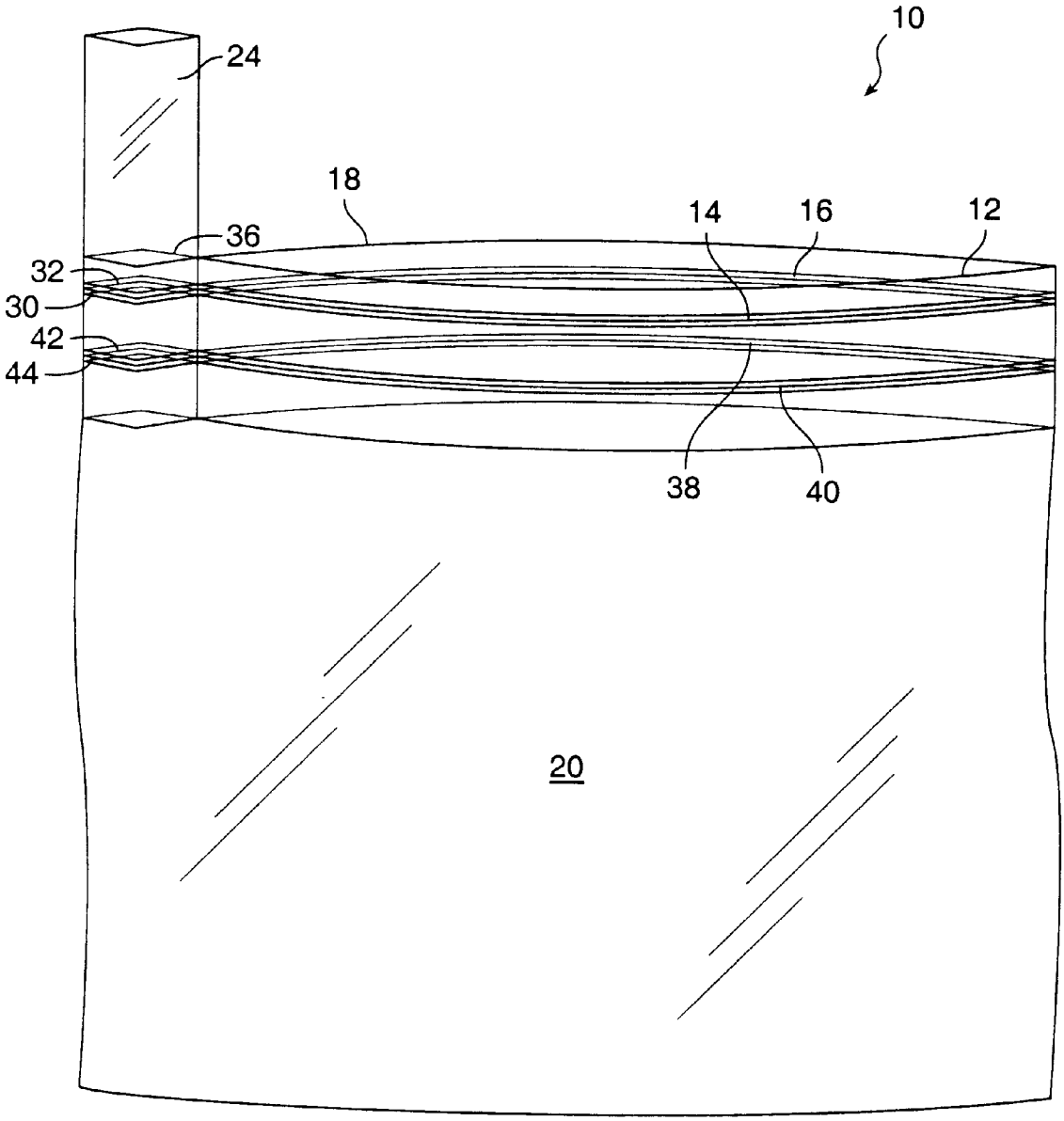
FIG. 1 is a perspective view of the vacuum sealing system according to the present invention.
Figure 2:
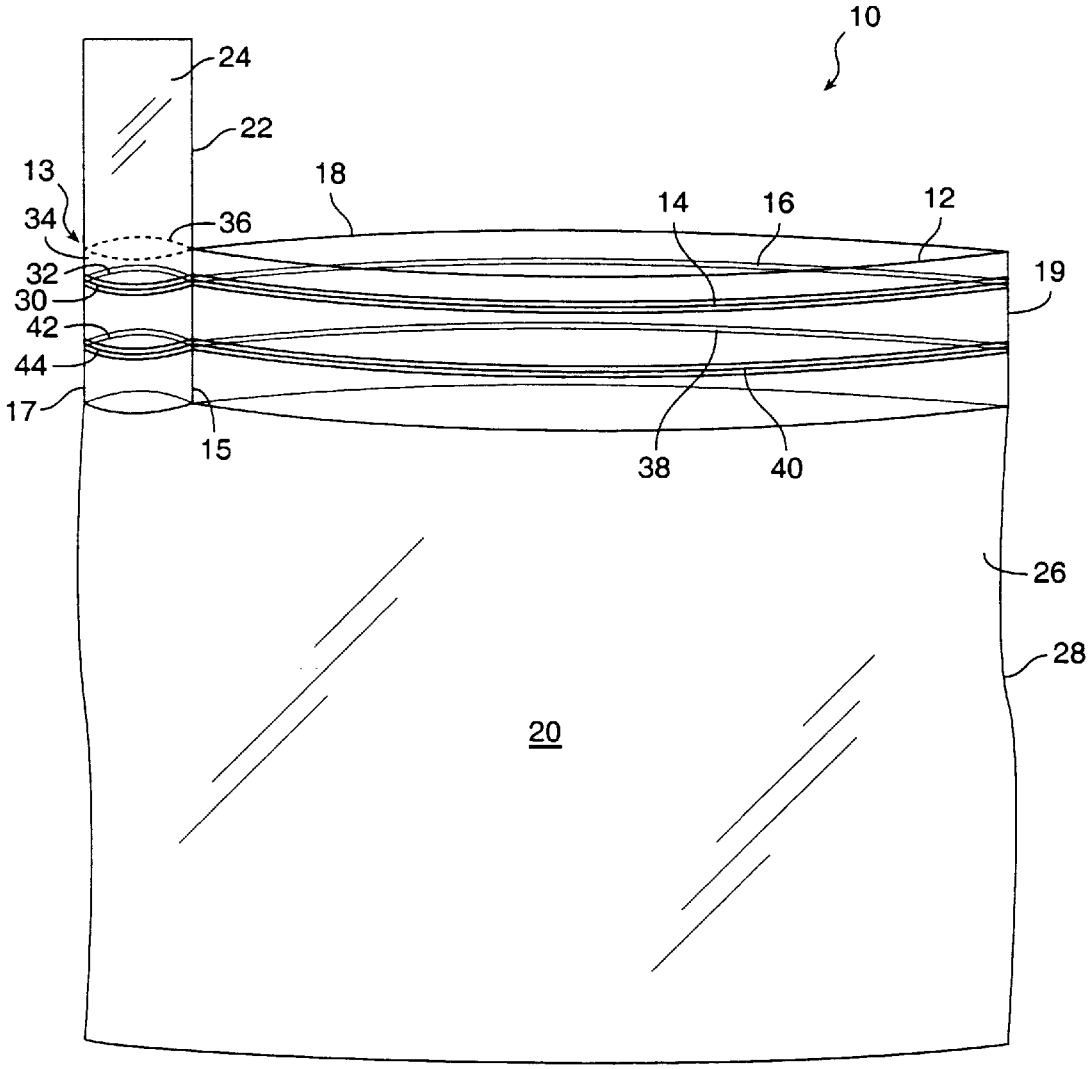
FIG. 2 is a side view of the invention as depicted in FIG. 1.

Referring to FIGS. 1 and 2 the features of the vacuum sealing system 10 are shown as integrated with one embodiment of a standard airtight sealing container system 12. As used herein the term vacuum refers to an environment containing little or no air.

Standard airtight sealing system 12 includes a protruding or male seam 14 capable of being joined to a receiving or female seam 16. The seams 14 and 16 extend substantially the entire length of container opening 18. The female seam 16 is disposed opposite to the male seam 14 and is adapted to mate with the male seam. Seams 14 and 16 are interlocked by properly aligning the male and female seams and pressing the seams together along the entire length of container opening 18 so that the locking mechanisms engage with one another. The seams 14 and 16 form an airtight seal on the container.

Protruding and receiving seams 14 and 16 may be molded or otherwise formed on the inside walls 28 of container 20 across opening 18, such that a user may close an airtight seal across container 20 after the air has been ventilated to or from the container. Airtight sealing system 12 is formed on container 20 during the manufacturing process. The airtight sealing system described above is well known in the art of sealable containers. Alternatively, sealing systems may be used in the present invention that do not use the system described above, but provide an equivalent sealing capability.

In one embodiment of the vacuum sealing system 10 of the present invention, a ventilation means 22 is integrated into airtight sealing system 12. As used herein, ventilation refers to allowing for the ingress or egress of a gas, liquid, vapor, or other forms of matter, most likely air. Ventilation means 22 is integrated so as not to impede the sealing function of airtight sealing system 12. The structure of ventilation means 22 can take many forms. Typically ventilation means 22 may include a valve, straw, or similarly functioning hollow structure, but is preferably a tube 24. Tube 24 may be molded or extruded and made of a resilient, transparent or non-transparent material. In one embodiment, tube 24 will be made of the same material as the reclosable container, for example, a thin clear plastic.

Figure 2A:
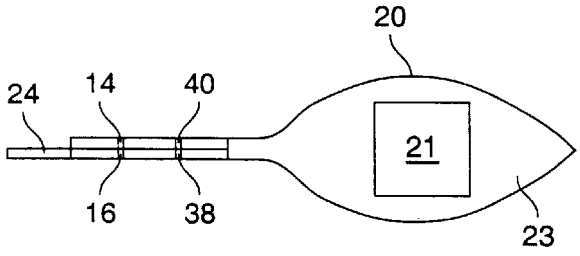
FIGS. 2A, 2B, and 2C are side views of embodiments of the present invention.

In yet another embodiment, tube 24 is in communication with content space 26 created by walls 28 of container 20. Tube 24 may be used to extract or fill container 20. In one embodiment, air is sucked out of container 20 through tube 24 using a suction force. Preferably, the suction force is created by the user's mouth. In this manner, a vacuum storage environment is created for the contents 21 of container 20 as illustrated in FIG. 2A.

Figure 2B:
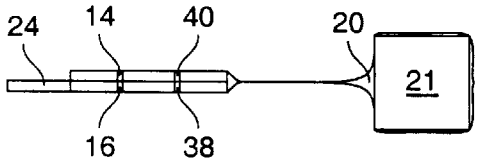

If air or other gas, liquid, vapor, or other substance is required to be stored with the contents 21 of container 20, tube 24 may be used to fill the container with the required substance 23 as shown in FIG. 2B.

Vacuum sealing system 10 allows the user to seal the container after it has been filled or evacuated with air, such that it is able to maintain the internal air pressure. In the configuration where air is supplied to container 20, the container may be used for materials that require certain gaseous or liquid environments, or to protect products during shipping.

Tube 24 may be hermetically sealed in a fashion similar to container 20 with another airtight sealing system 13. Protruding or male ridge 30 and receiving or female ridge 32, which are molded or otherwise formed on the inside walls 34 of tube 24, may close an airtight seal across tube 24 after the air has been ventilated to or from container 20.

As illustrated, the airtight sealing system 13 may be formed at the same time airtight sealing system 12 is formed, which is during the manufacturing process. It is envisioned that a seal seam 15 subsequently delineates the two portions of the airtight seal. In one embodiment, seal seam 15 physically separates airtight sealing system 12 from airtight sealing system 13. Further, seal seam 15 provides a "rip stop" which prevents the user from opening container opening 18 too wide. Seal seam 15 maybe formed by any conventional method, such as that used for forming seal seams 17 and 19, typically a heat seal.

Figure 2C:
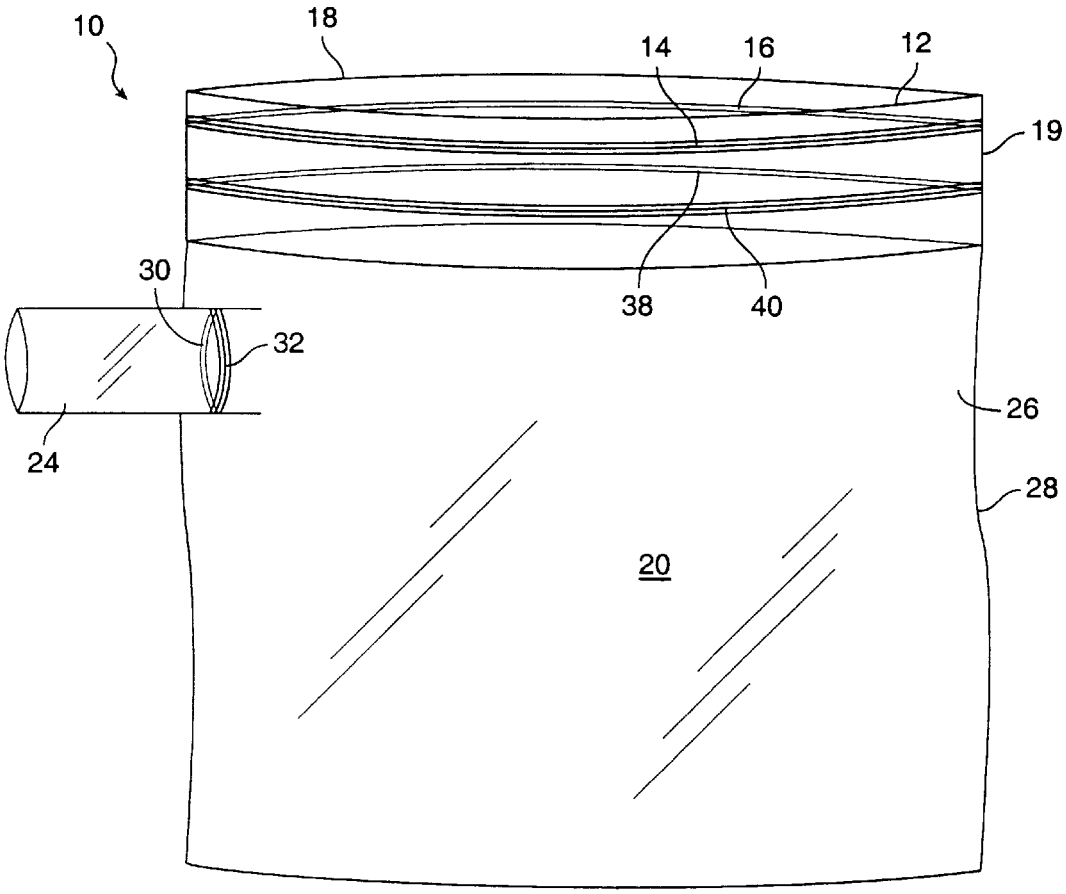

In one embodiment, ridges 30 and 32 extend across the entire length of tube 24. Male ridge 32 is disposed opposite to female ridge 30 and is adapted to mate with male ridge 32. Ridges 30 and 32 are interlocked by properly aligning the male and female ridges and pressing them together along their entire length, so that the locking mechanisms engage with one another. The ridges 30 and 32 form an airtight seal on tube 24. Walls 34 of tube 24 may be made of substantial strength and/or thickness to be capable of supporting tube 24 in an erect position, but tube 24 may perform just as well in a flaccid or unsupported condition. Tube 24 may be fashioned in any length, which will provide for adequate functioning of the ventilation means. Tube 24 can range from about 0.25 inch to one inch, preferably 0.5 inch in length. The diameter of tube 24 may also be any size selected to allow for proper evacuation of the container. Preferably, the diameter is about 0.25 inch to 0.5 inch. In an alternative embodiment, shown in FIG. 2C, tube 24 may be formed separate from the airtight sealing system. In this embodiment, tube 24 will have ridges 30 and 32 to interlock and to seal the tube, however the tube will not be integrated.

In one embodiment, tube 24 may have a crease or penetrating or non-penetrating perforations 36 for easy removal of tube 24. When tube 24 is no longer needed or desired in the vacuum sealing system, tube 24 may be removed from plastic container 20, by for example, cutting or tearing container 20 along the perforations 36. In the event that a penetrating perforation is used, the user may cover the perforations with his or her fingers to ensure sufficient air passage while the user is evacuating or filling container 20 through tube 24. Alternatively, tube 24 may be reinforced such that the tube will remain with plastic container 20 and not removed. This could be used as a safety feature to prevent injurious removal or swallowing of the tube.

In yet another embodiment, a second pair of joining airtight seams 38 and 40 may be embedded in the top of container 20 next to the first pair of seams 14 and 16. The second pair of seams 38 and 40 provide increased resistance to leakage of air into the vacuum-sealed container. A second pair of sealing ridges 42 and 44 may also be formed on walls 34 of tube 24 to also help to prevent air leakage. The second pair of seams 38 and 40 are particularly useful even when vacuum sealing is not desired, as it helps to increase the strength of the seal. Alternatively, additional pairs of sealing ridges or other sealing devices or methods can be added to sealing system 10 to increase the strength of the seal.

In yet another embodiment, walls 34 and seams 30 and 32 of tube 24 may be angled, contoured, and shaped so as to allow the tighter and more efficient sealing of tube 24. Also, this shaped configuration provides for the flattening of the evacuation means, which provides less stress to the seal.

Thus, the volume of container 20 may be minimized to provide for more efficient storage of the enclosed product.

Figure 3:
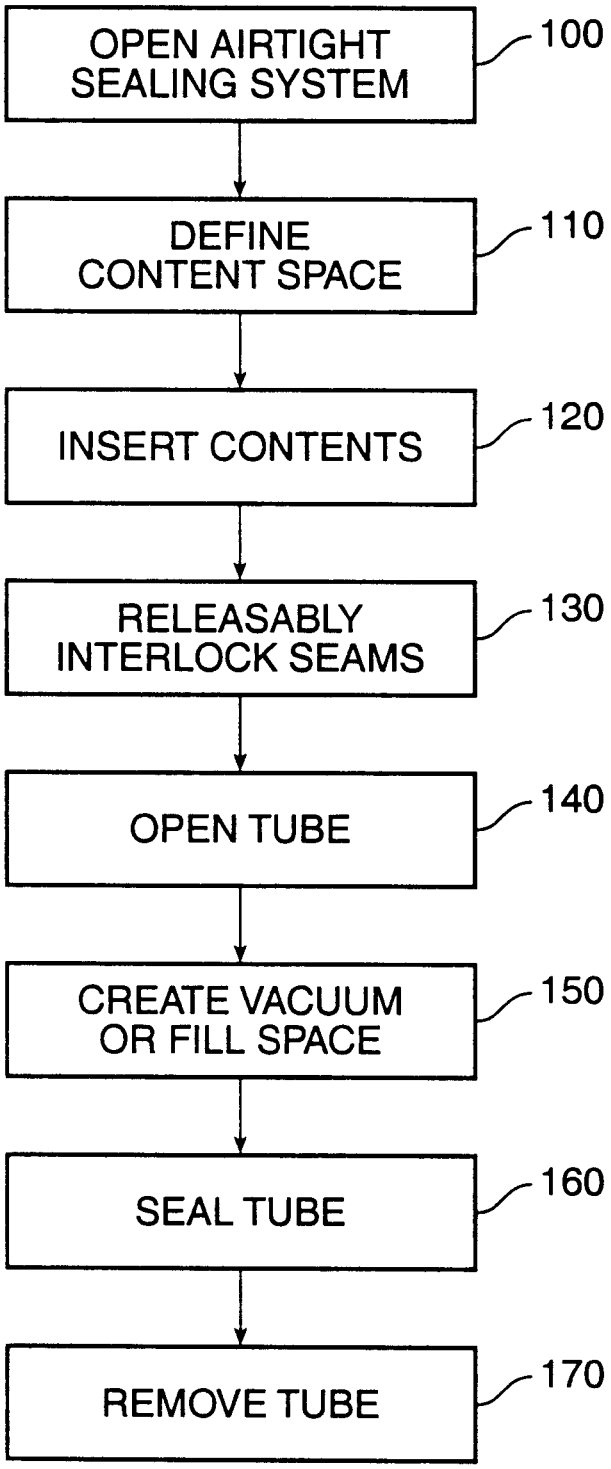
FIG. 3 is a flowchart illustrating the process of using the present invention.

In operation, vacuum sealing system 10 is easy and economical to use. Products stored using vacuum sealing system 10 have been shown to keep products fresher for longer periods of time. Food products maintain their flavor and retain their nutrients longer than non-vacuum packed products. A method of using an embodiment of the present invention is illustrated as a flowchart in FIG. 3. The method includes the step of opening 100 airtight sealing system 12, if seams 14 and 16 are interlocked. Walls 28 of container 20 may then be separated, step 110, to define content space 26. An item is then placed within content space 26, step 120. In an alternative embodiment, steps 110 and 120 may be performed in a single step.

The airtight sealing system 12 is engaged by interlocking seams 14 and 16, step 130. In one embodiment, step 130 is performed by applying pressure on seams 14 and 16, making them interlock. Typically, the pressure is applied by a finger, but may be applied by a clamp or similar device. Once airtight sealing system 12 is engaged, the user can open airtight sealing system 13 on tube 24, step 140, if required. In step 150, the user creates a vacuum environment in content space 26. Typically, the user will place his mouth on tube 24 and apply a sucking force to evacuate content space 26. In other embodiments, other sources for suction of content space 26 can be used. Once the vacuum operation is complete, tube 24 is sealed, step 160, using the methods described above. Optionally, tube 24 can be removed along a perforated portion once the tube is sealed, step 170.

In an alternative embodiment, in step 150, the user may fill the space with air, liquid, or other substance, if required. Typically, the user will supply the air using his mouth on tube 24 and applying a blowing force to fill content space 26. In other embodiments, other sources for occupation of content space 26 can be used.

Vacuum sealing system 10 does not require equipment or machinery for the purpose of evacuating or filling the body of the container with air. The vacuum sealing system can be reused as many times as desired, or at least until the plastic container itself will no longer hold the pressure of vacuum.

The ventilation means is easy to manufacture since it can be made using the same materials as the container. Since the ventilation means is completely integrated into the container, it is always conveniently available for uses.

While the above is a full description of the specific embodiments, various modifications, alternative constructions, and equivalents may be used. Therefore, the above description and illustrations should not be taken as limiting the scope of the present invention which is defined by the appended claims.

What is claimed is:

1. A sealable container comprising:

a container defining a product cavity having an opening and a resealable airtight sealing system; and an elongate ventilation mechanism integrated with the airtight sealing system for ventilating the product cavity, the ventilation mechanism accommodated by the sealing system so as to allow for airtight sealing of the ventilation mechanism.

2. The sealable container of claim 1, wherein a vacuum storage environment is created in the container by evacuating air through the ventilation mechanism.

3. The sealable container of claim 2, wherein the vacuum storage environment is created by sucking air out through the ventilation mechanism from the product cavity using a suction force.

4. The sealable container of claim 1, wherein air is forced into the product cavity through the ventilation mechanism to provide a filled air storage environment.

5. The sealable container of claim 4, wherein the filled air storage chamber is created by blowing air through the ventilation mechanism from a user's mouth into the product cavity.

6. The sealable container of claim 1, wherein the sealing system is integrated into an interior portion of the ventilation mechanism.

7. The sealable container of claim 1, wherein the ventilation mechanism comprises a tubular member in communication with the product cavity.

8. The sealable container of claim 7, wherein the tubular member is perforated to provide for easy removal of the tubular member.

9. The sealable container of claim 7, wherein the tubular member is reinforced to inhibit removal of the tubular member.

10. The sealable container of claim 7, wherein the tubular member is shaped to reduce stress on the sealing system when providing the airtight seal to increase resistance to leakage.

11. The sealable container of claim 1, wherein the ventilation mechanism sealing device comprises a pair of male and female interlocking sealing strips, the sealing strips being located adjacent, parallel and peripheral to each other.

12. A vacuum sealing system for a sealable container comprising:

a container body having an opening and defining a product cavity therein;

a sealing device for sealing the product cavity; and a tubular member in communication with the product cavity, the tubular member capable of providing ventilation of the product cavity to create a vacuum storage environment when the sealing device provides a seal.

13. The vacuum sealing system of claim 12, wherein the sealing device comprises a pair of male and female interlocking sealing strips, the sealing strips being located adjacent, parallel and peripheral to each other.

14. The vacuum sealing system of claim 12, further comprising a second sealing device to provide increased resistance to leakage.

15. The vacuum sealing system of claim 14, wherein the second sealing device comprises a pair of male and female interlocking sealing strips, the sealing strips being located adjacent, parallel and peripheral to each other.

16. The vacuum sealing system of claim 12, wherein the sealing device is integrated into an interior portion of the tubular member.

17. A method comprising:

providing a sealable container having an opening and a product cavity;

sealing the opening with a first sealing means;

venting air from the product cavity through a removable evacuation means, the evacuation means being in communication with the product cavity; and sealing the evacuation means with a second sealing means.

18. The method as in claim 17, wherein the air is vented by sucking the air out from the product cavity through the evacuation means using a suction force created by a user's mouth.

19. The method as in claim 17, wherein the second sealing means is integrated into an interior portion of the evacuation means.

20. The method as in claim 17, further comprising removing the evacuation means by tearing perforations.

21. The method of claim 17, further comprising providing a second pair of first and second sealing means to provide increased resistance to leakage.

22. In an improved reclosable container of the type including a container body defining a product cavity, and a sealing device, the improvement comprising:

an elongate evacuation mechanism in communication with the product cavity, the evacuation mechanism providing ventilation of the product cavity, wherein after the ventilation the sealing device provides a seal to the container body and to the elongate evacuation mechanism.

23. The improved reclosable container of claim 22, wherein the sealing device is integrated into an interior portion of the evacuation mechanism.

* * * * *